United States Patent [19]

Yamaguchi

[11] Patent Number: 4,836,773

[45] Date of Patent: Jun. 6, 1989

[54] STITCHLESS BURNING WICK

[75] Inventor: Isaburo Yamaguchi, Nigata, Japan

[73] Assignee: Kitate Sangyo Co., Inc., Nigata, Japan

[21] Appl. No.: 238,278

[22] Filed: Aug. 30, 1988

[30] Foreign Application Priority Data

Feb. 1, 1988 [JP] Japan ..... 63-12370[U]

[51] Int. Cl.[4] ..... F23D 3/18

[52] U.S. Cl. ..... 431/325

[58] Field of Search ..... 431/325, 302, 303, 304, 431/305, 306, 307, 308, 309

[56] References Cited

U.S. PATENT DOCUMENTS

| | | | |
|---|---|---|---|
| 1,367,392 | 2/1921 | Hoffman | 431/202 X |
| 4,652,235 | 3/1987 | Yamaguchi | 431/325 |
| 4,720,260 | 1/1988 | Yamaguchi | 431/325 |

FOREIGN PATENT DOCUMENTS

| | | | |
|---|---|---|---|
| 2905 | 1/1982 | Japan | 431/325 |
| 12211 | 1/1984 | Japan | 431/325 |

*Primary Examiner*—Randall L. Green

*Attorney, Agent, or Firm*—Young & Thompson

[57] ABSTRACT

A stitchless burning wick comprising a tubular wick body comprising a burner part and an oil suction part having opposite abutting edges. A plurality of channel-like connecting members are spaced apart and straddle the opposite abutting edges of the burner part and the oil suction part. These members have legs which extend inwardly of the wick body from outside the wick body and then toward each other and then toward the outside so as to embrace yarns of the wick body. A holding tape is disposed over the connecting members and has a size covering only the vicinity of the opposite abutting edges and overlying portions of the burner part and the oil suction part along the opposite abutting edges. The connecting members have been given an anticorrosion treatment. A circumferential tape overlies only adjacent portions of the burner part and oil suction part, the members penetrating this circumferential tape. The holding tape is elongated in the axial direction of the tubular wick body and extends at both its ends beyond the circumferential tape. The holding tape is elongated in the axial direction of the tubular wick body.

5 Claims, 4 Drawing Sheets

STITCHLESS BURNING WICK

BACKGROUND OF THE INVENTION

The present invention relates to a hollow tubular burning wick produced by forming into a tube a wick body consisting of a burner part and an oil suction part having opposite abutting edges that are secured to each other. More particularly, the invention concerns a stitchless burning wick in which the opposite abutting edges of the burner part and the oil suction part are integrated in a very simple and inexpensive manner by a plurality of channel-like connecting members which are independent from each other, and a holding tape, and having a joint strength which remains high for a long time.

Various structures of burning wick are known, having a burner part and an oil suction part, or if desired also a stretching part.

In one example of the production of a burning wick having a burner part and an oil suction part, a wick body having a burner part and an oil suction part is knitted into a continuous band on a warp knitting machine (e.g. a raschel machine). This wick body is cut to a predetermined length by an appropriate cutter. This wick body thus cut to length is looped to form a hollow tube by abutting the opposite cut end edges, and thereafter, the abutted end edges are stitched together with zigzag stitching parallel to the axial direction of the wick. Such a burning wick is disclosed, for example, in Japanese Utility Model Laid Open No. 52-157535 (No. 157535/1977), Japanese Patent Laid Open No. 51-17038 (No. 17038/1966) and No. 51-44325 (No. 44325/1976).

Also, Japanese Patent Laid Open No. 61-246505 (No. 246505/1986) corresponding to U.S. Pat. No. 4,652,235 and No. 62-66008 (No. 66008/1987) disclose a method of obtaining a hollow tube burning wick without requiring any stitching of the opposite abutting edges, as mentioned above.

However, when the burning wick requires stitching as mentioned above, there are the problems that it is complicated to produce and so becomes high in cost.

Also, when the burning wick does not require stitching, even though it is less expensive, nevertheless another problem arises because, in order to retain the strength of the joint between the opposite abutting edges, it is necessary to use a reinforced joining tape having a large area or a large joining element having a zigzag or checkered shape. Particularly, in the case wherein the burning wick is of a type using such joining elements, the latter will be corroded by fuel, whereby there arise the problems that the opposite abutting edges of the wock body deteriorate in strength and that the wick body loses its function as a burning wick.

OBJECTS OF THE INVENTION

An object of the present invention is to provide a stitchless burning wick in which a very strong joint is obtained in a minimum size.

Another object of the invention is to provide a stitchless burning wick of low cost both as to labor and as to materials.

SUMMARY OF THE INVENTION

In order to attain the above objects, the present invention provides a stitchless burning wick which is produced by forming into a tube a wick body consisting of a burner part and an oil suction part having opposite abutting edges, having a plurality of channel linkage connecting members which are independent from each other and which are adapted to straddle said opposite abutting edges of said burner part and said oil suction part. These connecting members are spaced apart in the axial direction of said wick body and extend from outside said wick body toward the inside and have engaging edges which, after penetrating the wick, are bent toward each other and then back outwardly at their free ends so as to embrace the yarn of said wick body. A holding tape, which is disposed over said connecting members has a size to cover said opposite abutting edges and is applied to straddle said burner part and said oil suction part along the axial direction of said opposite abutting edges.

DESCRIPTION OF THE DRAWINGS

The present invention will be further described with reference to the accompanying drawings which illustrate a non-limiting example, and in which.

DETAILED DESCRIPTION OF THE INVENTION

Figure 1:
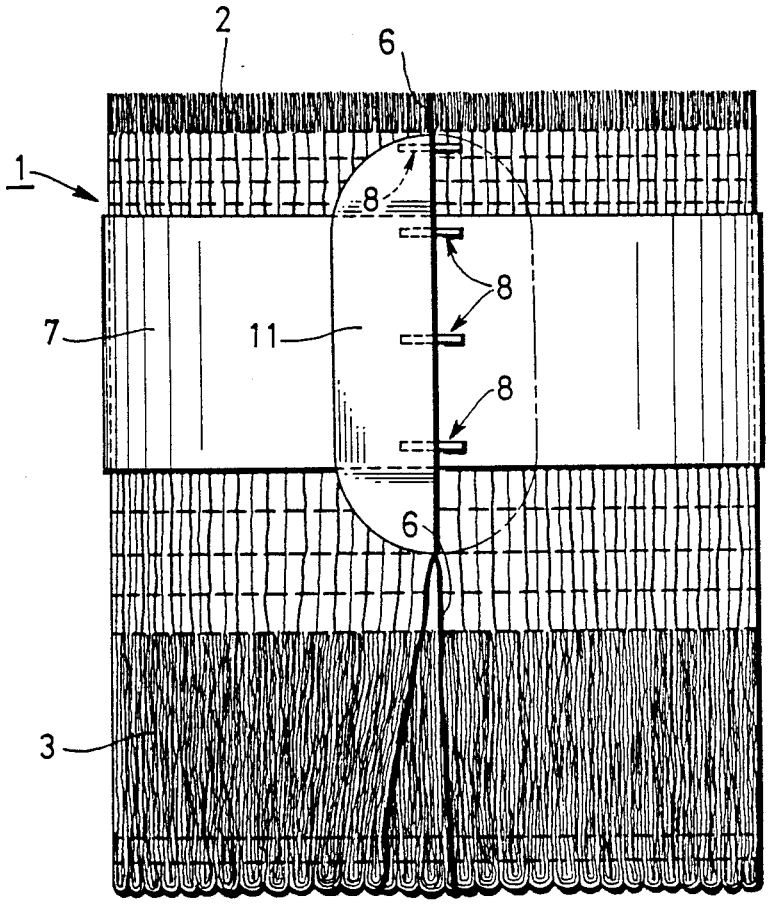
FIG. 1 is a front view showing a burning wick of a preferred embodiment according to the present invention, with a portion of the holding tape broken away.
Figure 2:
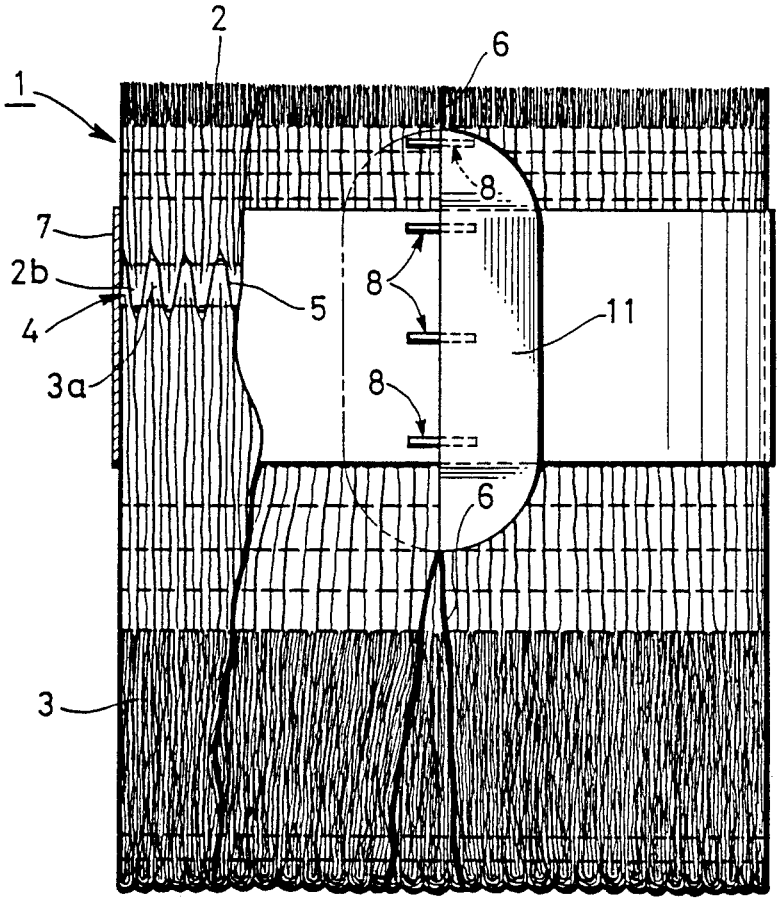
FIG. 2 is a front view thereof with other portions of the holding tape broken away.
Figure 3:
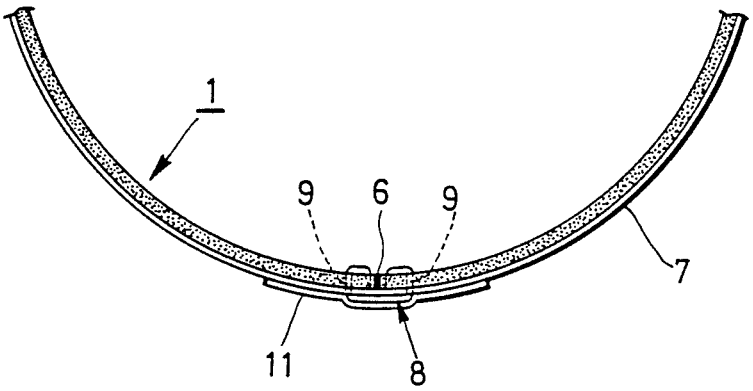
FIG. 3 is a plan view showing a portion of FIG. 2.

A burning wick according to the invention is designated by reference numeral 1. The burning wick 1 comprises a burner part 2 and an oil suction part 3. The burner part 2 is made of heat resistant fiber yarn, such as glass fiber or the like. The oil suction part consists of oil soakable fiber yarn, such as cotton staple fiber or the like. The burner part 2 and the oil suction part 3 are knitted simultaneously on a warp knitting machine (e.g. a raschel machine) in a well known manner. At a connecting portion 4 between the burner part 2 and the oil suction part 3, return ends of the yarns **2*b* and 3*a* intermix with one another to cross in a comb-like fashion. This cross-connecting portion 4 is integrally interwoven with a binding yarn 5**. The knitting of such a wock body is automatically effected in a well-known manner on said warp knitting machine.

The wick body thus obtained is then cut to a predetermined required length. That is, it is cut in a direction perpendicular to the longitudinal direction thereof. The wick body thus cut to a certain length is looped to form a hollow tube. The looped wick body is abutted at the respective longitudinal end edge portions of the burner part 2 and the oil suction part 3. To the entire periphery is applied and adhesively secured a circumferential tape 7 which straddles the opposite abutting edges 6 and covers the cross connecting portion 4 and adjacent portions of the burner part 2 and the oil suction part 3. Tape 7 may be of the materials recited in the above U.S. Pat. No. 4,652,235.

A plurality of channel-like connecting members 8 are provided, which are separate from each other and which are spaced apart along the axial direction of the wick body. The members 8 have been subjected to an anticorrosion treatment by any desired conventional method of anticorrosion treatment. Such anticorrosion treatment can be, for example, coating with an anticorrosion pigment, such as zinc chromate, lead cyanamide or the like. The material of the members 8 can be for example mild steel.

Figure 4:
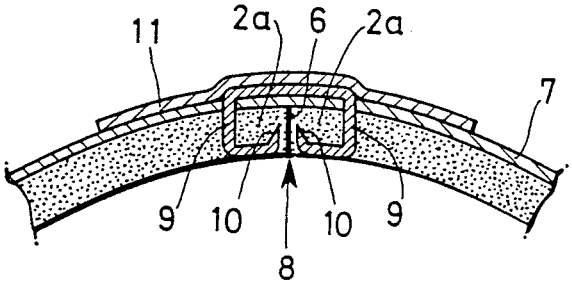
FIG. 4 is an enlarged cross sectional view showing the opposite abutting edges.
Figure 5:
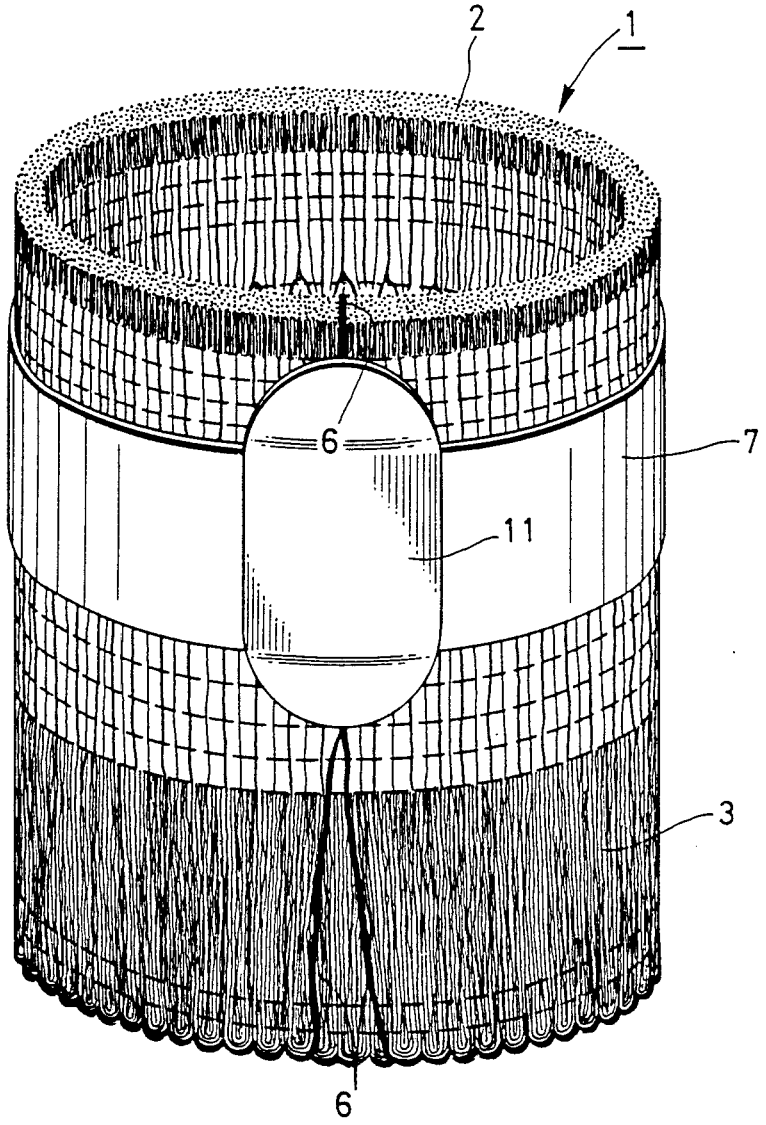
FIG. 5 is a perspective view showing a burning wick according to the present invention.

The connecting members 8 have leg portions 9 at both ends to penetrate the wick body at equal distances from the opposite abutting edges 6. These leg portions 9 penetrate from outside of the wick body upwardly. The leading pointed ends 10 of the leg portions 9 are further bent back from the inside of the wick body outwardly thereby firmly embracing yarns 2*a* along both edges 6 (see FIG. 4). Naturally, the same structure also exists in the oil suction part 3.

Because the connecting members 8 are separate from each other, the distance between them and their positions can be selected in accordance with the desired joint strength. Also, because the connecting members 8 straddle the opposite abutting edges 6, it is easy to automate the application of the connecting members 8 by mans of an automatic machine because the line of application is rectilinear.

An oval holding tape 11 is applied and adhesively secured over the connecting members 8 and along the axial direction of the abutting edges 6 and over adjacent portions of the burner part 2 and te oil suction portion 3 lying beyond tape 7. Useful as a holding tape 11 are, for example, synthetic resins, papers on which a reinforcing treatment has been performed, or analogous materials. The holding tape 11 may possess a width which covers only the region of the opposite abutting edges 6, because the opposite abutting edges 6 have already been securely interconnected by the connecting members 8 so as not to separate from each other. Accordingly, the opposite abutting edges 6 are joined and held integrally by triple connecting means comprising the circumferential tape 7, the connecting members 8 and the holding tape 11. Therefore, the strength of the joint is very great in the vertical, horizontal and diagonal directions of the opposite abutting edges so as to preclude the possibility of gaps forming between the latter.

The connecting members 8 can be applied by the use of a conventional stapling machine, which positions the wick body in the region of the edges 6 between a driving head and a solid surface so shaped as to deflect the ends 10 that have penetrated the wick first toward each other and then outwardly, so as to grip a substantial bundle of wick fibers on each side of the joint.

Thus the wick produced will be seen to be of inexpensive materials and to be produced by an inexpensive method, and yet to have great strength. Thus the initially-recited objects of the invention have been achieved.

What is claimed is:

1. A stitchless burning wick comprising a tubular wick body comprising a burner part and an oil suction part having opposite abutting edges, a plurality of channel-like connecting members which are spaced apart and straddle said opposite abutting edges of said burner part and said oil suction part, said members having legs which extend inwardly of the wick body from outside said wick body and then toward each other and then toward the outside so as to embrace yarns of said wick body; and a holding tape which is disposed over said connecting members and which has a size covering only the vicinity of said opposite abutting edges and which overlies portions of said burner part and said oil suction part along said opposite abutting edges.

2. A stitchless burning wick according to claim 1, wherein said connecting members have been given an anticorrosion treatment.

3. A stitchless burning wick according to claim 1, having a circumferential tape overlying only adjacent portions of said burner part and oil suction part, said members penetrating said circumferential tape.

4. A stitchless burning wick as claimed in claim 3, said holding tape being elongated in the axial direction of the tubular wick body and extending at both its ends beyond said circumferential tape.

5. A stitchless burning wick as claimed in claim 1, said holding tape being elongated in the axial direction of the tubular wick body.

* * * * *